US005873164A

United States Patent [19]

Klement et al.

[11] Patent Number: 5,873,164

[45] Date of Patent: Feb. 23, 1999

[54] METHOD FOR MANUFACTURING A FAN WHEEL

[75] Inventors: Johann Klement, Traunwalchen; Peter Kellermann, Burghausen, both of Germany

[73] Assignee: BSH Bosh und Siemens Hausgeraete GmbH, Munich, Germany

[21] Appl. No.: 904,499

[22] Filed: Aug. 1, 1997

Related U.S. Application Data

[62] Division of Ser. No. 587,724, Jan. 19, 1996, Pat. No. 5,685,695.

[30] Foreign Application Priority Data

Jan. 19, 1995 [DE] Germany ..... 195 01 533.9

[51] Int. Cl.[6] ..... B23P 15/00

[52] U.S. Cl. ..... 29/889.4; 29/889

[58] Field of Search ..... 29/889.4, 557; 416/182, 185, 223 B, 183

[56] References Cited

U.S. PATENT DOCUMENTS

| | | | |
|---|---|---|---|
| 2,176,325 | 10/1939 | Bretzlaff et al. | 416/DIG. 3 |
| 2,465,671 | 3/1949 | Mulligen et al. | 29/889.4 |
| 2,831,630 | 4/1958 | Perry | 29/889.4 |
| 3,301,472 | 1/1967 | Dixon et al. | 416/223 |
| 3,376,057 | 4/1968 | Buren, Jr. | 416/DIG. 3 |
| 3,521,973 | 7/1970 | Schow | 29/889.4 |
| 3,737,966 | 6/1973 | Ranz | 29/889.4 |
| 3,914,069 | 10/1975 | Arrington et al. | 416/132 A |
| 3,951,611 | 4/1976 | Morrill | 416/DIG. 3 |

*Primary Examiner*—T. Cuda
*Attorney, Agent, or Firm*—Herbert L. Lerner; Laurence A. Greenberg

[57] ABSTRACT

A fan wheel for high-temperature operation, especially in ovens, includes a star-like or ray-like base plate having a central middle region, protrusions protruding substantially radially beyond the central middle region and having an outer contour, axially drawn up blades disposed on the protrusions and a base plate surface with axially drawn up segments extending from the middle region into the vicinity of the protrusions. According to one embodiment, the segments include a central, annular segment and star-like or ray-like segments adjoining the central, annular segment and extending through the protrusions of the base plate substantially symmetrically with the outer contour. According to another embodiment, the segments include a central, annular segment and star-like or ray-like segments adjoining the central, annular segment, originating from the central, annular segment and following the outer contour of the base plate. A method for manufacturing a high-temperature fan wheel includes initially axially drawing shapings and optionally bulges from a flat, preferably metal blank and subsequently cutting away the contour of the base plate and bending the blades relative to the base plate.

8 Claims, 1 Drawing Sheet

METHOD FOR MANUFACTURING A FAN WHEEL

This is a division of application Ser. No. 08/587,724 filed on Jan. 19, 1996 now U.S. Pat. No. 5,685,695.

BACKGROUND OF THE INVENTION

1. Field of the Invention:

The invention relates to a fan wheel for high-temperature operation, especially in ovens, including a star-like or ray-like base plate having a central middle region, protrusions protruding substantially radially beyond the central middle region, axially drawn up blades disposed on the protrusions and a base plate surface with axially drawn up segments extending from the middle region into the vicinity of the protrusions. The invention also relates to a method for manufacturing the fan wheel.

In a known fan wheel with a substantially star-shaped base plate and axially pulled or drawn up blades on the radial protrusions, which taper largely to a point, an annular bead is impressed, or in other words axially pulled or drawn up, all around the axial opening in the central middle region, and from there ray-like radial beads extend into the region of the radial protrusions. The radial beads extend asymmetrically with respect to the contour of the aforementioned protrusions. Such fan wheels are made of thin sheet metal material. Tests especially in the high-temperature range have shown that even after a relatively short time in operation, the radial protrusions become more or less deformed, causing the fan output to drop and producing irritating running noise.

2. Summary of the Invention:

It is accordingly an object of the invention to provide a fan wheel and a method for manufacturing the same, which overcome the hereinafore-mentioned disadvantages of the heretofore-known methods and devices of this general type and with which the fan wheel is improved in such a way that even under highly varying temperature conditions, an exact, constant geometry and balanced position of the fan wheel are preserved.

With the foregoing and other objects in view there is provided, in accordance with the invention, a fan wheel for high-temperature operation, comprising a star-like or ray-like base plate having: a central middle region; protrusions protruding substantially radially beyond the central middle region and having an outer contour; axially drawn up blades disposed on the protrusions; and a base plate surface with axially drawn up segments extending from the middle region into the vicinity of the protrusions; the segments including a central, annular segment and star-like or ray-like segments adjoining the central, annular segment and extending through the protrusions of the base plate substantially symmetrically with the outer contour.

With the objects of the invention in view, there is also provided a fan wheel for high-temperature operation, comprising a star-like or ray-like base plate having: an outer contour; a central middle region; protrusions protruding substantially radially beyond the central middle region; axially drawn up blades disposed on the protrusions; and a base plate surface with axially drawn up segments extending from the middle region into the vicinity of the protrusions; the segments including a central, annular segment and star-like or ray-like segments adjoining the central, annular segment, originating from the central, annular segment and following the outer contour of the base plate.

In accordance with another feature of the invention, the segments are constructed as shapings.

In accordance with a further feature of the invention, the segments are substantially flat shapings having surfaces being drawn up relative to the base plate.

In accordance with an added feature of the invention, the segments merge with one another and are parts of a common segment and preferably of a common shaping.

In accordance with an additional feature of the invention, the segments have an outer contour, and there are provided peripheral surfaces of at least approximately constant width being disposed between the outer contour of the protrusions and the outer contour of the segments.

In accordance with yet another feature of the invention, the segments have a ray-like region and a drawn up depth being decreased as seen radially outwardly toward the ray-like region.

In accordance with yet a further feature of the invention, the segments have ray-like regions and axially drawn up embossed surfaces being constructed as shapings and provided with additionally axially drawn up bulges preferably having a circular outline, in transitional regions between the central annular region and the ray-like regions.

In accordance with yet an added feature of the invention, the base plate has a middle region, the ray-like protrusions have a root region, and the segments include an annular, axially drawn up segment in the middle region of the base plate extending at least approximately as far as the root region of the ray-like protrusions and being adjoined continuously by the star-like or ray-like segments.

In accordance with yet an additional feature of the invention, there is provided a a surface coating, preferably a layer of enamel, being disposed on the base plate.

With the objects of the invention in view, there is additionally provided a method for manufacturing a high-temperature fan wheel, which comprises initially axially drawing shapings and optionally bulges from a flat, preferably metal blank and subsequently cutting away the contour of the base plate and bending the blades relative to the base plate.

The axially pulled or drawn up segments, which are preferably constructed as generally flat stampings or shapings, lend the base plate such dimensional stability and heat resistance, even under an extreme thermal load, for instance up to 500° C. when used in pyrolytic self-cleaning ovens, that no alteration of the geometrical relationships takes place, the balanced state is preserved, and a running noise that remains constantly low is achieved. Especially because of the largely symmetrical contouring of the segments, for instance from the presence of a largely constant edge between the segments and the outer contour of the base plate, thermally dictated expansions of material cannot cause partial rejections. Due to these properties that promote dimensional stability, it becomes possible to use even relatively thin, preferably metal sheet material with a low thermal capacity without having to fear disadvantages in terms of concentricity. Due to the aforementioned dimensional stability, the possibility also readily exists of providing the fan wheel with a relatively easily broken coating, for instance a catalytically self-cleaning enamel coating. Not the least advantage is the fact that the fan wheel according to the invention is distinguished by low production costs.

Other features which are considered as characteristic for the invention are set forth in the appended claims.

Although the invention is illustrated and described herein as embodied in a fan wheel and a method for manufacturing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
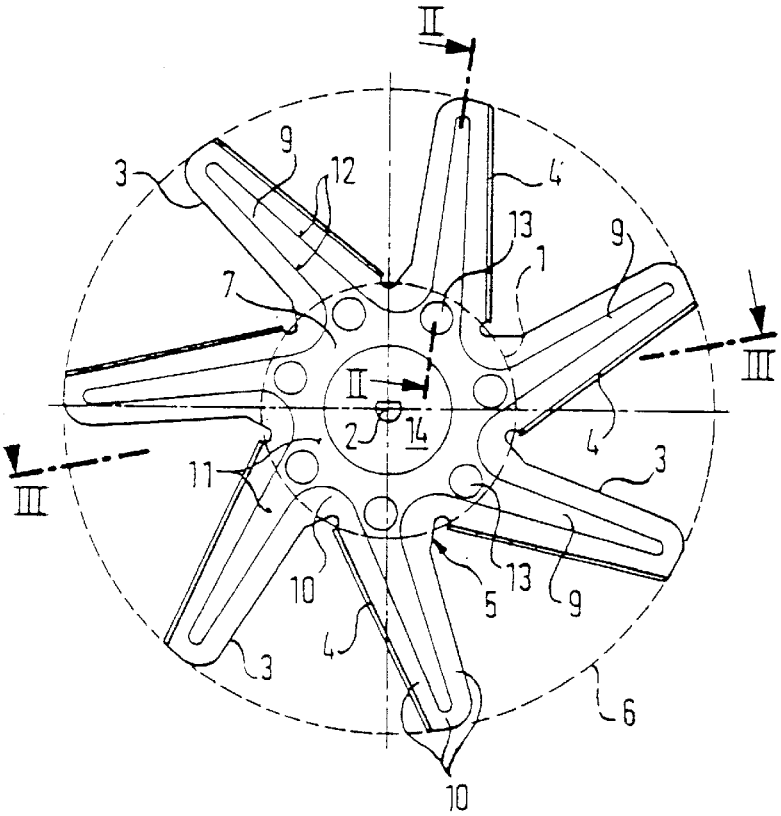
FIG. 1 is a diagrammatic, top-plan view of a fan wheel.

Referring now to the figures of the drawing in detail and first, particularly, to FIG. 1 thereof, there is seen a fan wheel which has a central middle region 1 that is represented by a circle and in the center of which a non-round axial opening 2 is located, for mounting on a non-illustrated drive shaft of a drive motor. The central middle region 1 is adjoined by vane-like protrusions 3 protruding radially past the middle region. A total of seven projections 3 are provided. The section line II—II follows the axis of symmetry of one of the protrusions 3. As the section line II—II particularly makes clear, the axes of symmetry of the protrusions 3 do not extend precisely radially but rather are slightly inclined from the associated radials.

Figure 2:
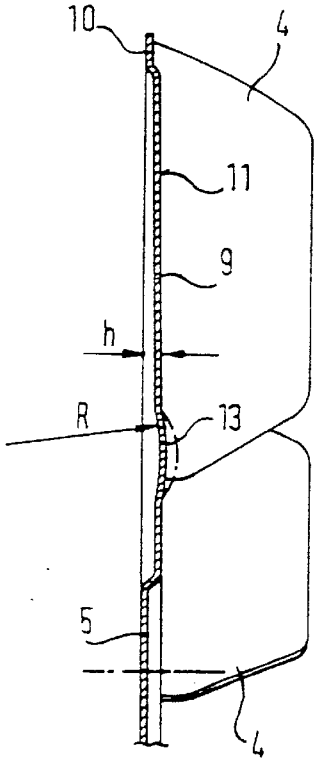
FIG. 2 is an enlarged, fragmentary, sectional view of the fan wheel which is taken along a line II—II of FIG. 1, in the direction of the arrows.
Figure 3:
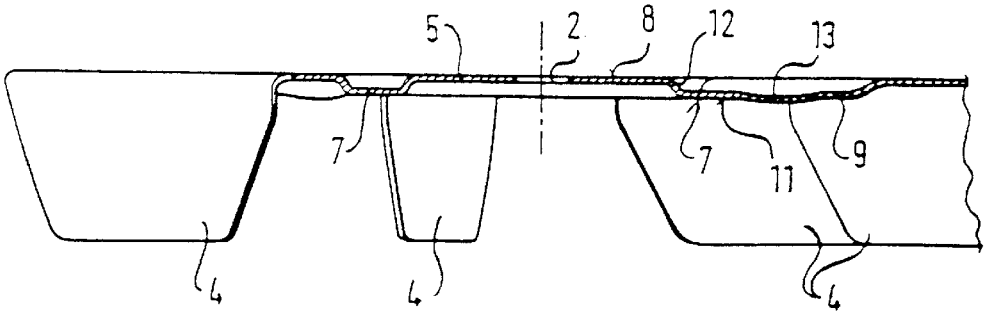
FIG. 3 is a further enlarged, sectional view of the fan wheel which is taken along a line III—III of FIG. 1, in the direction of the arrows.

The protrusions 3 taper slightly toward the outside and have blades 4 which are each bent at a right angle at one lateral boundary, as can be seen from FIGS. 2 and 3. Both the middle region 1 and the protrusions 3 are components of a one-piece base plate 5 made of thin material, for instance metal sheet, from which the blades 4 are bent at right angles. A circle 6 shown in dashed lines illustrates the outer periphery of the fan wheel.

As FIGS. 1 and 3 particularly show, an annular segment 7 in the form of an annular, generally flat shaping is formed in the central middle region 1, is axially pulled or drawn up or precessed relative to a base plane 8 and is adjoined directly and seamlessly by star-shaped or ray-like segments 9 corresponding in number to the number of protrusions 3. As FIG. 1 shows, these ray-like segments 9 extend through the protrusions 3 substantially symmetrically to the outer contour of these protrusions 3. The segments 9 extend nearly to the ends of the protrusions 3, resulting in largely constant peripheral ribs or peripheral surfaces 10 between the outer contours of the fan wheel or base plate 5, including the root regions of the protrusions. In the exemplary embodiment, the contouring of the segments 9 beginning at the middle region 1 follows the outer contour of the base plate 5, forming the aforementioned peripheral surfaces 10 of constant width.

As FIGS. 2 and 3 show, the axially pulled or drawn up segments 9 which are constructed as shapings have substantially flat surfaces 11, which merge, by gentle, largely rounded and therefore streamlined transitions 12, with the base plane 8. The ray-like segments 9 taper outward, corresponding to the tapered contour of the vane-like protrusions 3. As FIG. 2 shows, a stamping depth h also decreases in the region of the ray-like segments 9. Due to the fact that the protrusions 3 do not extend exactly radially to the center of the fan wheel, asymmetrical courses of the round outer contour edges result in the root regions of the ray-like protrusions 3, and thus unequal circular portions are also created in these root regions. In order to create approximately symmetrical or identical geometrical conditions in these regions as well, it is provided that in the transition regions between the central annular region and the ray-like regions, the axially pulled or drawn up embossed surfaces 11 are equipped with additionally axially pulled or drawn up bulges 13 with a circular outline and with a radius R. These bulges 13 may also have a smaller radius R, as is suggested by a dot-dashed line in FIG. 2.

In a preferred method of the invention for manufacturing the aforementioned fan wheel, it is provided that first the segments 7 and 9 (shapings) that merge directly and seamlessly with one another are axially pulled or drawn up in an embossing process from a flat metal blank which, for instance, is dimensioned in accordance with the peripheral circle 6, subsequently the star-like or ray-like contour of the base plate 5 is cut away or stamped out, and subsequently or in a common stamping and embossing process, the blades 4 are bent away relative to the base plate 5. In this way, embossing-dictated material strains in the peripheral surfaces 10 in the base plane 8 are avoided. It has also proved to be advantageous in this respect if the surfaces 11 serve as a starting plane for the embossing process, relative to which surfaces the regions that surround the shapings, and in particular the peripheral surfaces 10 and a central circular surface 14 in the center of the fan wheel, are axially pulled or drawn up by embossing. Next, the fan wheel can be provided with a surface coating in a known manner.

The advantages attained by the embodiment of the fan wheel according to the invention are displayed particularly in the use of metal material deformed by embossing. However, other materials or shapes for the fan wheel are conceivable, such as the use of plastic, in which case suitable shaping processes should be employed, to create the shapings, which are to be understood as a three-dimensional form.

We claim:

1. In a method for manufacturing a high-temperature fan wheel including a star-like or ray-like base plate having a contour, a central middle region, protrusions protruding substantially radially beyond the central middle region and having an outer contour, axially drawn up blades disposed on the protrusions, and a base plate surface with axially drawn up segments extending from the middle region into the vicinity of the protrusions, the segments having a central, annular segment and star-like or ray-like segments adjoining the central, annular segment and extending through the protrusions of the base plate substantially symmetrically with the outer contour of the protrusions, the improvement which comprises:

initially axially drawing shapings forming the segments from a flat blank; and subsequently cutting away the contour of the base plate and bending the blades relative to the base plate.

2. The method according to claim 1, which comprises axially drawing the shapings from a flat metal blank.

3. The method according to claim 1, which comprises axially drawing bulges from the flat blank.

4. The method according to claim 1, which comprises axially drawing regions surrounding the shapings by embossing.

5. In a method for manufacturing a high-temperature fan wheel including a star-like or ray-like base plate having an outer contour, a central middle region, protrusions protruding substantially radially beyond the central middle region, axially drawn up blades disposed on the protrusions, and a base plate surface with axially drawn up segments extending from the middle region into the vicinity of the protrusions, the segments having a central, annular segment and star-like or ray-like segments adjoining the central, annular segment, originating from the central, annular segment and following the outer contour of the base plate, the improvement which comprises:

initially axially drawing shapings forming the segments from a flat blank; and subsequently cutting away the contour of the base plate and bending the blades relative to the base plate.

6. The method according to claim 1, which comprises axially drawing the shapings from a flat metal blank.

7. The method according to claim 1, which comprises axially drawing bulges from the flat blank.

8. The method according to claim 1, which comprises axially drawing regions surrounding the shapings by embossing.

* * * * *